US009142374B1

(12) United States Patent
Shen

(10) Patent No.: US 9,142,374 B1
(45) Date of Patent: Sep. 22, 2015

(54) SOLENOID LINEAR ACTUATOR AND METHOD OF MAKING SAME

(71) Applicant: Jun Shen, Phoenix, AZ (US)

(72) Inventor: Jun Shen, Phoenix, AZ (US)

( * ) Notice: Subject to any disclaimer, the term of this patent is extended or adjusted under 35 U.S.C. 154(b) by 0 days.

(21) Appl. No.: 14/280,535

(22) Filed: May 16, 2014

Related U.S. Application Data

(60) Provisional application No. 61/888,510, filed on Oct. 9, 2013.

(51) Int. Cl.

| | |
|---|---|
| ***H01H 53/00*** | (2006.01) |
| ***H01H 50/58*** | (2006.01) |
| ***H01H 50/64*** | (2006.01) |
| ***H01H 50/36*** | (2006.01) |
| ***H01P 1/12*** | (2006.01) |

(52) U.S. Cl.
CPC ..... *H01H 50/58* (2013.01); *H01H 50/36* (2013.01); *H01H 50/641* (2013.01); *H01P 1/125* (2013.01); *H01H 2235/01* (2013.01)

(58) Field of Classification Search
CPC ..... H01P 1/125
USPC ..... 335/4, 5; 333/105–108, 259
See application file for complete search history.

(56) References Cited

U.S. PATENT DOCUMENTS 5,652,558 A * 7/1997 Leikus et al. ..... 335/4

* cited by examiner

*Primary Examiner* — Ramon Barrera

(57) ABSTRACT

A solenoid linear actuator comprises a unibody soft magnetic core with a central body and an upper disk and narrower end extrusions, and a pair of soft magnetic bodies on the two ends of the solenoid. When the solenoid is energized, unibody core is magnetized and attracted to the soft magnetic plates from below, pulling unibody core downward. The extrusions on the two ends of unibody core actuate external mechanisms (pushers and cantilevers, respectively) to accomplish various electrical switching operations. A permanent magnet can be added to the upper side to assist the actuation.

13 Claims, 4 Drawing Sheets

An improved solenoid linear actuator in the de-energized state.

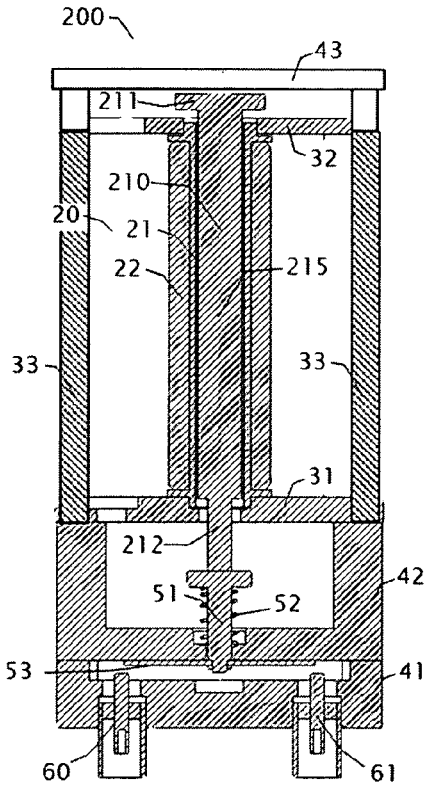
Fig. 2A. An improved solenoid linear actuator in the de-energized state.
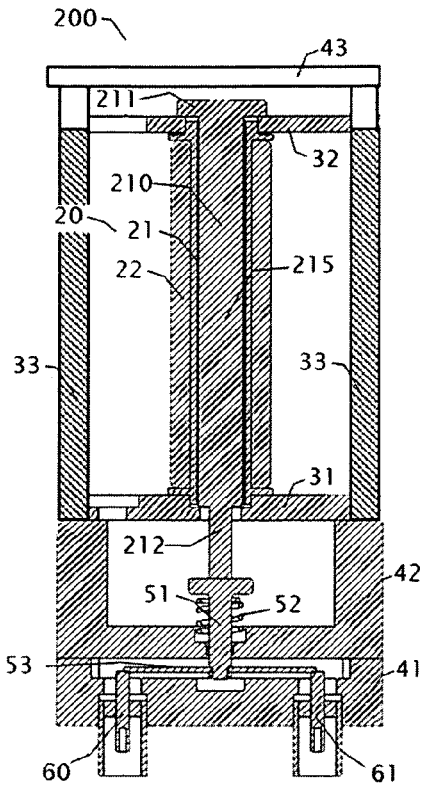
Figure 2B. An improved solenoid linear actuator in the energized state.

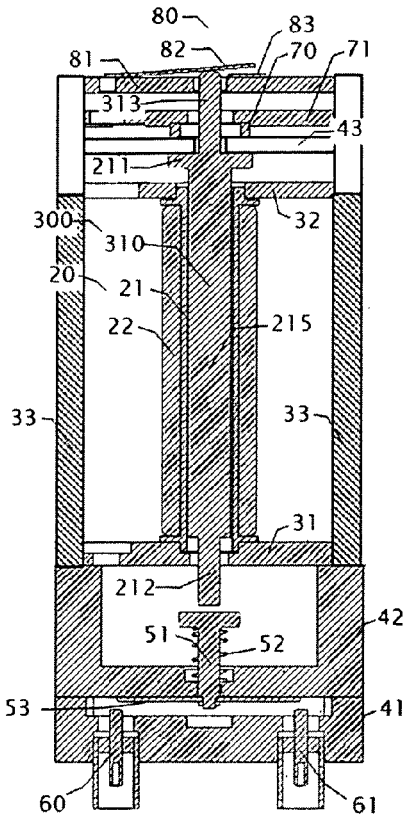
Fig. 3A. An improved solenoid linear actuator with an auxiliary switch in the de-energized state.
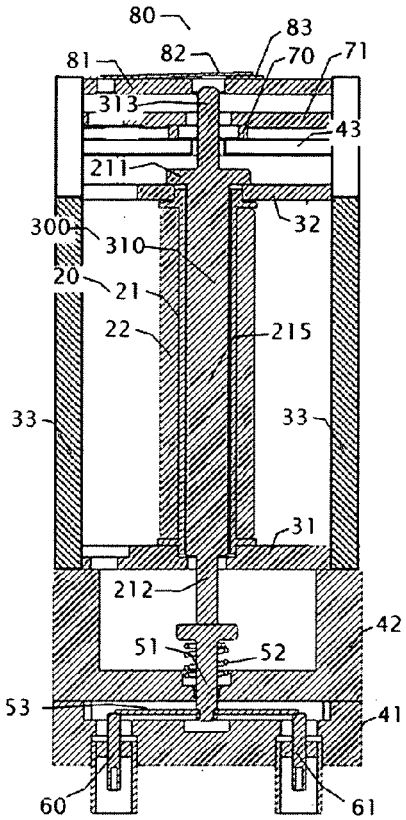
Fig. 3B. An improved solenoid linear actuator with an auxiliary switch in the energized state.

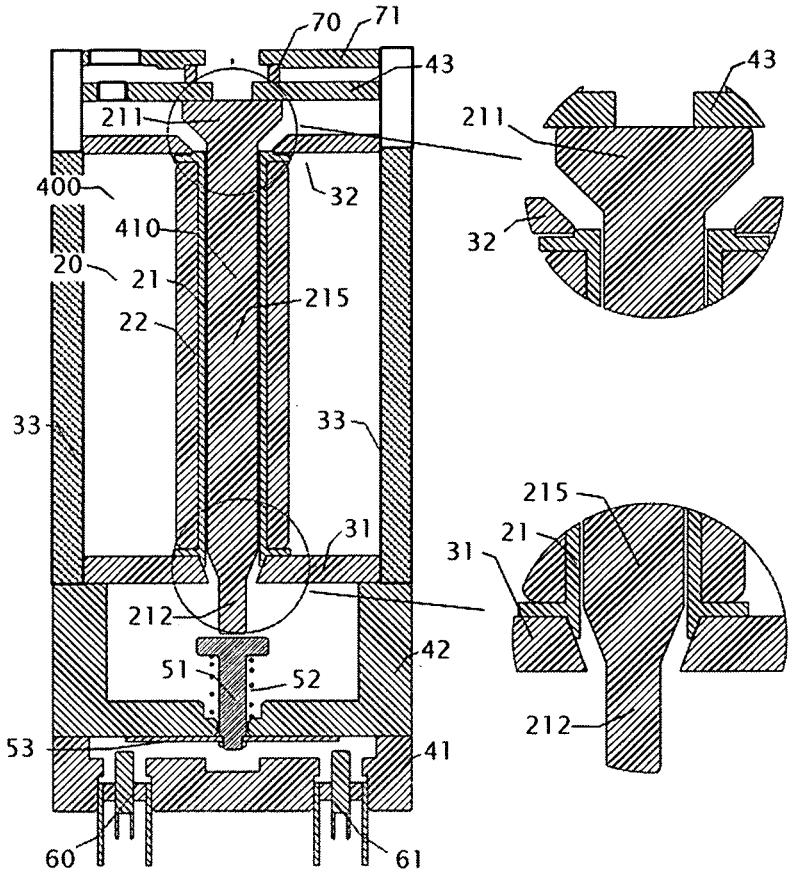
Figure 4. Cross-sectional view.

SOLENOID LINEAR ACTUATOR AND METHOD OF MAKING SAME

FIELD OF THE INVENTION

The present invention relates to solenoid linear actuators used in switches and relays. More specifically, the present invention relates to solenoid linear actuators used in failsafe coaxial RF switches and to methods of making the linear actuators.

BACKGROUND OF THE INVENTION

Relays are electromechanical switches operated by a flow of electricity in one circuit and controlling the flow of electricity in another circuit. A typical relay consists basically of an electromagnet with a soft iron bar, called an armature, held close to it. A movable contact is connected to the armature in such a way that the contact is held in its normal position by a spring. When the electromagnet is energized, it exerts a force on the armature that overcomes the pull of the spring and moves the contact so as to either complete or break a circuit. When the electromagnet is de-energized, the contact returns to its original position. Variations on this mechanism are possible: some relays have multiple contacts; some are encapsulated; some have built-in circuits that delay contact closure after actuation; some, as in early telephone circuits, advance through a series of positions step by step as they are energized and de-energized, and some relays are of latching type.

Coaxial RF switches are special types of electromechanical relays (or switches) wherein radio frequency (RF) signals are connected or disconnected between terminals in the switch. Typically a coaxial RF switch utilizes a pusher to push a conductor reed to make contact with a pair of coaxial conductor heads and connect the signal path between the two coaxial conductors. A common design uses a soft magnetic rocker under a pair of electromagnets to push the pusher for the switching action. The rocker-electromagnet assembly is typically symmetrical in construction in latching (bi-stable) type of switches. An additional restoring spring is added below one side of the rocker in a failsafe design to ensure the rocker returns to a predetermined state when the electromagnet is de-energized such that normally-on and normally-off arrangements can be achieved in the RF terminals. In such a failsafe design, strong magnetic attraction exists between the electromagnet and the rocker, therefore the strength of the restoring spring must be properly adjusted to achieve the desired normally-off contact configuration when the electromagnet is de-energized with reasonable power consumption during the "on" state when the electromagnet is energized. Such a balance is usually difficult and increased power consumption is necessary. The restoring spring also adds to the complexity in fabrication. Another failsafe-type of design uses a solenoid linear actuator to cause the conductor to connect and disconnect the RF terminals. Such a prior art solenoid linear actuator (FIG. 1) comprises a solenoid 20 which further comprises a coil 22 wound around a bobbin 21. Energizing solenoid 20 magnetizes soft magnetic core 10 and causes it to be attracted to soft magnetic bodies 18 and 19. The downward movement of soft magnetic core 10 pushes a push pin 15 and thus pusher 51 downward, causing conductor 51 to connect the RF terminals 60 and 61. A drawback in such a design is that soft magnetic body 14 is inserted inside of solenoid 20, and push pin 15 needs to be made of non-magnetic material and separated from soft magnetic core 10 which adds complexity in manufacturing and assembly. Another drawback is that the initial air gaps between the two ends of soft magnetic core 10 and soft magnetic bodies 18 and 19 are relatively large, causing unnecessarily large coil power consumption.

It is highly desirable to provide a solenoid linear actuator which is simple to manufacture and consumes low power during operations.

It is a purpose of the present invention to provide a new and improved solenoid linear actuator which is simple to manufacture and consumes low power during operations.

SUMMARY OF THE INVENTION

The above problems and others are at least partially solved and the above purposes and others are realized in solenoid linear actuator comprising a unibody soft magnetic core and a pair of soft magnetic bodies on the two ends of the solenoid wherein a narrower end of the unibody soft magnetic core extends through a hole in the lower soft magnetic body to push the external pusher during actuation processes. The hole in the lower soft magnetic body has at least two steps to reduce the initial vertical air gap between the unibody soft magnetic core and the soft magnetic body while allowing the unibody soft magnetic core to maintain the necessary room to travel. Similarly a ring-type of permanent magnet on the top can allow a narrower end of the unibody soft magnetic core to extend through the hole of the permanent magnet ring to push a cantilever to achieve optional indicator functions.

BRIEF DESCRIPTION OF THE FIGURES

The above and other features and advantages of the present invention are hereinafter described in the following detailed description of illustrative embodiments to be read in conjunction with the accompanying figures, wherein like reference numerals are used to identify the same or similar parts in the similar views, and:

FIG. 2A is a cross-sectional view of an exemplary embodiment of an improved solenoid linear actuator of the present invention in the de-energized state;

FIG. 2B is a cross-sectional view of an exemplary embodiment of an improved solenoid linear actuator of the present invention in the energized state;

FIG. 3A is a cross-sectional view of another exemplary embodiment of an improved solenoid linear actuator of the present invention with an auxiliary switch in the de-energized state;

FIG. 3B is a cross-sectional view of another exemplary embodiment of an improved solenoid linear actuator of the present invention with an auxiliary switch in the energized state.

FIG. 4 is a cross-sectional view of another exemplary embodiment of an improved solenoid linear actuator of the present invention in the de-energized state.

DETAILED DESCRIPTION OF EXEMPLARY EMBODIMENTS

Figure 1:
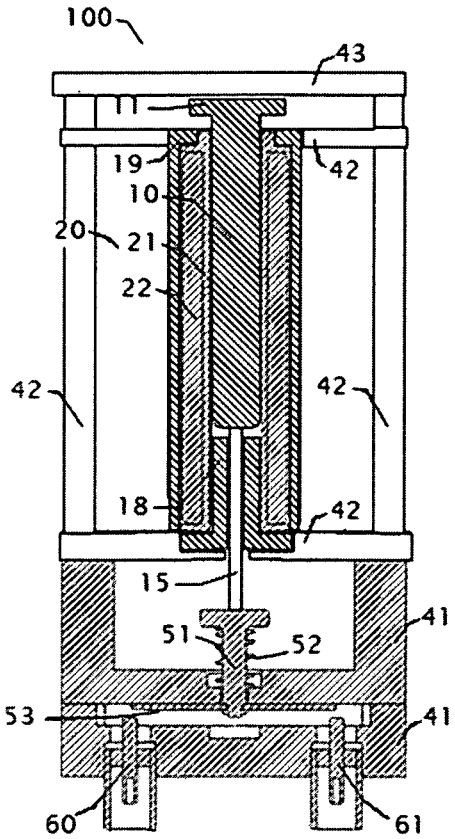
Figure 1. Prior art.
FIG. 1 is a cross-sectional view of a prior art solenoid linear actuator in a failsafe coaxial RF switch.

It should be appreciated that the particular implementations shown and described herein are examples of the invention and are not intended to otherwise limit the scope of the present invention in any way. Indeed, for the sake of brevity, conventional electronics, manufacturing, and other functional aspects of the systems (and components of the individual operating components of the systems) may not be described in detail herein. Furthermore, for purposes of brevity, the invention is frequently described herein as pertaining to an electromagnetic relay or switches for use in electrical or electronic systems. It should be appreciated that many other manufacturing techniques could be used to create the relays described herein, and that the techniques described herein could be used in mechanical relays, optical switches, fluidic control systems, or any other switching devices. Further, the techniques would be suitable for application in electrical systems, optical systems, consumer electronics, industrial electronics, wireless systems, space applications, fluidic control systems, medical systems, or any other application. Moreover, it should be understood that the spatial descriptions made herein are for purposes of illustration only, and that practical failsafe switches may be spatially arranged in any orientation or manner. Multi-pole-multi-throw types of these switches can also be formed by arranging them in appropriate ways and with appropriate devices.

FIG. 1 is a cross-sectional view of a prior art solenoid linear actuator in a failsafe coaxial RF switch. With reference to FIG. 1, a prior art solenoid linear actuator 100 suitably comprises a solenoid 20 with a coil 22 wound around a bobbin 21, a soft magnetic core 10, soft magnetic bodies 18 and 19, and a non-magnetic push pin 15. Solenoid linear actuator 100 is supported by various supporting structures 41, 42, and 43 and is arranged relative to pusher 51, restoring spring 52, conductor reed 53, stationary coaxial conductors 60 and 61 in a failsafe coaxial RF switch.

When coil 22 is not energized as shown in FIG. 1, restoring spring 52 pushes pusher 51 upward and disconnects the RF connection between coaxial conductors 60 and 61. When coil 22 is energized, soft magnetic core 10 is magnetized and its top end 11 is attracted to soft magnetic body 19 and its bottom end is attracted to soft magnetic body 18. The collective attraction force pulls soft magnetic core 10 downward so that it pushes pushing pin 15, pusher 51 and conductor reed 53 downward until conductor reed 53 touches stationary conductors 60 and 61 and connecting them.

As aforementioned, a drawback in such a design is that soft magnetic body 18 is inserted inside of solenoid 20, and push pin 15 needs to be made of non-magnetic material and separated from soft magnetic core 10 which adds complexity in manufacturing and assembly. Another drawback is that the initial vertical air gaps between soft magnetic core 10 and soft magnetic bodies 18 and 19 are relatively large, causing unnecessarily large coil power consumption.

FIGS. 2A and 2B are cross-sectional views of an exemplary embodiment of an improved solenoid linear actuator in a failsafe coaxial RF switch of the present invention. With reference to FIG. 2, an improved solenoid linear actuator 200 suitably comprises a unibody soft magnetic core 210 with a central body 215 and an upper disk 211 and a lower-end extrusion 212, an upper soft magnetic plate 32 and a lower soft magnetic plate 31, soft magnetic supporting structure 33, and a solenoid 20 with coil 22 wound around bobbin 21. Lower-end extrusion 212 of soft magnetic core 210 is narrower than the openings of lower soft magnetic plate 31 such that lower-end extrusion 212 can extend through said opening of plate 31 without touching and interfering with plate 31. Plate 31 has a stepping structure in its opening with a narrower portion on the lower side. Such a stepping structure reduces the initial vertical air gap between plate 31 and said central body 215 of core 210 without obstructing the necessary vertical movement of core 210 in solenoid 20. Actuator 200 is arranged relative to a pusher 51 with restoring spring 52 and conductor reed 53, and stationary coaxial conductors 60 and 61.

Coil 22 is formed by having multiple windings of conducting wires around bobbin 21. Soft magnetic core 210 (with central body 215, lower-end extrusion 212 and upper disk 211) and soft magnetic bodies 31, 32, and 33 can be made of any soft magnetic material including Iron, NiFe, or any other soft magnetic material which has high permeability (e.g., from about 100 to above $10^5$) and can easily be magnetized by the influence of an external magnetic field. Soft magnetic bodies 31, 32, and 33 also supports actuator 200 and other elements in the coaxial RF switch.

Pusher 51 is supported by a restoring spring 52 and connects to a conductor reed 53. Pusher 51 can be made of any dielectric material. Spring 52 can be made of stainless steel. Conductor reed 53 can be made of any conducting material such as BeCu and are preferably plated with Gold.

Stationary conductors 60 and 61 can be made of any conducting materials such as Cu, Cu alloys, etc., and are preferably Gold-plated.

Frame structures 41 and 42 are made of rigid materials such as Al, Cu, etc., and are provided to support the various components in the coaxial RF switch. A limiter plate 43 can be made of any rigid material such as metal or plastics and is provided to limit upward movement of core 210.

In a broad aspect of the invention, a solenoid linear actuator 200 comprises a unibody soft magnetic core 210 with an upper disk 211 and a lower-end extrusion 212, and a pair of soft magnetic bodies 31 and 32 on the two ends of a solenoid 20, wherein a narrower lower-end extrusion 212 of the unibody soft magnetic core extends through a hole in the lower soft magnetic body 31. Energizing coil 22 magnetizes unibody soft magnetic core 210 and causes it to be attracted toward soft magnetic plates 31 and 32. The downward movement of core 210 causes its lower-end extrusion 212 to push external pusher 51 and causes conductor reed 53 to touch and connect coaxial conductors 60 and 61 (FIG. 2A). De-energizing coil 22 removes the magnetic attraction between core 210 and soft magnetic plates 31 and 32, allowing restoring spring 52 to lift pusher 51 upward and disconnecting conductor 60 and 61 (FIG. 2B). The opening in lower soft magnetic plate 31 has at least two steps to reduce the initial vertical air gap between said central body 215 of unibody soft magnetic core 210 and soft magnetic plate 31 while allowing unibody soft magnetic core 210 to travel inside solenoid 20. Similarly, the stepping structure can also be formed in the opening of upper soft magnetic plate 32 to reduce the initial vertical air gap between upper disk 211 of unibody soft magnetic core 210 and upper plate 32.

FIGS. 3A and 3B are cross-sectional views of another exemplary embodiment of an improved solenoid linear actuator in a coaxial RF switch of the present invention. With reference to FIG. 3, an improved solenoid linear actuator 300 suitably comprises a unibody soft magnetic core 310 with a central body 215 and an upper disk 211 and an upper-end extrusion 313, a lower-end extrusion 212, an upper soft magnetic plate 32 and a lower soft magnetic plate 31, soft magnetic supporting structure 33, a permanent magnet 70 and a soft magnetic plate 71, a solenoid 20 with coil 22 wound around bobbin 21, and an auxiliary switch 80.

Permanent magnet 70 has preferably a ring shape with a central opening and can be made of any permanent (hard) magnetic material, such as NdFeB, SmCo, AlNiCo, ceramic magnets (made of Barium and Strontium Ferrite), CoPtP alloy, and others, that can maintain a remnant magnetization ($B_r=\mu_0 M$) from about 0.001 T (10 Gauss) to above 1 T ($10^4$ Gauss), with coercivity ($H_c$) from about $7.96\times10^2$ A/m (10 Oe) to above $7.96\times10^5$ A/m ($10^4$ Oe). Permanent magnet 70 is preferably magnetized along its vertical axis orientation such that its polarity is opposite to the polarity of core 310 when coil 22 is energized, resulting in a repelling force on upper disk 211 from permanent magnet 70 when coil 22 is energized. On the other hand, when coil 22 is not energized, upper disk 211 is magnetized by permanent magnet 70 and is attracted to permanent magnet 70.

Unibody soft magnetic core 310 (with central body 215, lower-end extrusion 212, upper disk 211 and upper-end extrusion 313) can be made of any soft magnetic material including Iron, NiFe, or any other soft magnetic material which has high permeability (e.g., from about 100 to above $10^5$) and can easily be magnetized by the influence of an external magnetic field.

Auxiliary switch 80 comprises a cantilever 82 and a stationary contact 83 mounted on a printed circuit board (PCB) 81. Cantilever 82 can be made of conducting flexible material such as BeCu with one end affixed to PCB 81 and the other end (preferably plated with Au) flexible to deflect. Stationary contact 83 can be made of any contact material such as Au, Ag, Cu, or other suitable metal or alloys. PCB 81 has a hole which is concentric to the holes in permanent magnet 70, soft magnetic plates 71, 32, and 31, and supporting (spacer) plate 43, and concentric to core 310.

When coil 22 is not energized, permanent magnet 70 attracts upper disk 211 of core 310 and pulls unibody core 310 upward until it being stopped by plate 43. The upward movement of unibody core 310 allows its narrower extrusion 313 to push cantilever 82 upward, disconnecting cantilever 82 from stationary contact 83 (FIG. 3A). When coil 22 is energized in such a manner as to magnetize core 310 with a same polarity to that of permanent magnet 70, a repelling force on upper disk 211 from permanent magnet 70 assists the downward movement of unibody core 310. This repelling force on unibody core 310 from permanent magnet 70 is additional to the attractive forces on unibody core 310 from plates 31 and 32, effectively reduces the initial coil current needed to actuate core 310. Cantilever 82 returns to its un-deflected state and makes contact with stationary contact 83 when extrusion 313 is separated from it (FIG. 3B).

In a broad aspect of the invention, a solenoid linear actuator 300 comprises a unibody soft magnetic core 310 (with a central body 215, an upper disk 211, and an upper-end extrusion 313, and a lower-end extrusion 212), and a pair of soft magnetic bodies 31 and 32 on the two ends of a solenoid 20, a permanent magnet 70 and a soft magnetic plate 71, and an auxiliary switch 80. When coil 20 is not energized, permanent magnet 70 attracts upper disk 211 and pulls unibody core 310 upward. When coil 20 is energized, unibody core 310 is magnetized in such a way as to be repelled by permanent magnet 70 from the top and to be attracted to soft magnetic plates 31 and 32 from below, respectively pushing and pulling unibody core 310 downward. The extrusions (212 and 313) on the two ends of unibody core 310 actuate external mechanisms (pusher 51 and cantilever 82, respectively) to accomplish various electrical switching operations.

FIG. 4 is a cross-sectional view of an exemplary embodiment of an improved solenoid linear actuator in a de-energized state of a failsafe coaxial RF switch of the present invention. With reference to FIG. 4, an improved solenoid linear actuator 400 suitably comprises a unibody soft magnetic core 410 with an upper disk 211 and a lower-end extrusion 212 and a central body 215, an upper soft magnetic plate 32 and a lower soft magnetic plate 31, soft magnetic supporting structure 33, and a solenoid 20 with coil 22 wound around bobbin 21. Lower-end extrusion 212 of soft magnetic core 210 is narrower than the openings of lower soft magnetic plate 31 such that lower-end extrusion 212 can extend through said opening of plate 31 without touching and interfering with plate 31. Plate 31 has a sloping structure in its opening with a decreasing diameter downwardly and said unibody soft magnetic core 410 has a corresponding sloping structure transitioning from its central body 215 to its lower-end extrusion 212 (see detailed exploded view in FIG. 4). Such a sloping structure reduces the initial vertical air gap between plate 31 and core 410 without obstructing the necessary vertical movement of core 410 in solenoid 20. Actuator 400 is arranged relative to a pusher 51 with restoring spring 52 and conductor reed 53, and stationary coaxial conductors 60 and 61.

In a broad aspect of the invention, a solenoid linear actuator 400 comprises a unibody soft magnetic core 410 with an upper disk 211 and a lower-end extrusion 212 and a central body 215, and a pair of soft magnetic bodies 31 and 32 on the two ends of a solenoid 20, wherein a narrower lower-end extrusion 212 of the unibody soft magnetic core extends through a hole in the lower soft magnetic body 31. Energizing coil 22 magnetizes unibody soft magnetic core 410 and causes it to be attracted toward soft magnetic plates 31 and 32. The downward movement of core 410 causes its lower-end extrusion 212 to push external pusher 51 and causes conductor reed 53 to touch and connect coaxial conductors 60 and 61. De-energizing coil 22 removes the magnetic attraction between core 410 and soft magnetic plates 31 and 32, allowing permanent magnet 70 to attract upper disk 211 and to help restoring spring 52 to lift pusher 51 and conductor reed 53 upward and disconnect conductor 60 and 61 (FIG. 4). The opening in lower soft magnetic plate 31 and the unibody soft magnetic core 410 have corresponding sloping structures to reduce the initial vertical air gap between unibody soft magnetic core 410 and soft magnetic plate 31 while allowing unibody soft magnetic core 410 to travel inside solenoid 20. Similarly, the sloping structures can also be formed in the opening of upper soft magnetic plate 32 and upper disk 211 to reduce the initial vertical air gap between upper disk 211 of unibody soft magnetic core 210 and upper plate 32.

It is understood that a variety of methods can be used to fabricate the solenoid linear actuator. The detailed descriptions of various possible fabrication methods are omitted here for brevity.

It will be understood that many other embodiments and combinations of different choices of materials and arrangements could be formulated without departing from the scope of the invention. Similarly, various topographies and geometries of the electromechanical relay could be formulated by varying the layout of the various components.

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above.

What is claimed is:

1. A solenoid linear actuator in a coaxial radio frequency switch comprising:

a solenoid having multiple conducting wires wound around a bobbin;

a unibody soft magnetic core having a central body further comprising an upper disk and a lower end extrusion at its two ends, wherein the diameters of said upper disk, said central body and said lower end extrusion are in a descending order;

an upper soft magnetic plate and a lower soft magnetic plate, wherein said upper and lower soft magnetic plates comprising openings which are primarily concentric to said soft magnetic core, and wherein the diameter of said opening in the upper soft magnetic plate is preferably larger than the diameter of said central body of soft magnetic core and smaller than the diameter of said upper disk, and the diameter of the opening in said lower soft magnetic plate is preferably larger than the diameter of said lower end extrusion;

a pusher-conductor assembly supported by a restoring spring;

at least two conductor terminals;

wherein energizing said solenoid magnetizes said soft magnetic core and causes said soft magnetic core to be attracted to said upper and lower soft magnetic plates and pushes said pusher-conductor assembly downward to connect said conductor terminals; and wherein de-energizing said solenoid removes the magnetization in said soft magnetic core and cancels the magnetic attraction between said soft magnetic core and the upper and lower soft magnetic plates and consequently said restoring spring pushes said pusher-conductor assembly upward to disconnect said conductor terminals.

2. A solenoid linear actuator according to claim [1] wherein the opening in said lower soft magnetic plate comprising a first stepping structure with a first upper step and a first lower step, wherein the diameter of the opening in said first upper step is preferably larger than the diameter of the opening in said first lower step.

3. A solenoid linear actuator according to claim [2] wherein the diameter of the opening in said first lower step is preferably larger than the diameter of said lower end extrusion and slightly smaller than the diameter of said central body of said soft magnetic core.

4. A solenoid linear actuator according to claim [1] wherein the opening in said upper soft magnetic plate comprising a second stepping structure with a second upper step and a second lower step, wherein the diameter of the opening in said second upper step is preferably larger than the diameter of the opening in said second lower step.

5. A solenoid linear actuator according to claim [4] wherein the diameter of the opening in said second lower step is preferably larger than the diameter of said central body of said soft magnetic core and smaller than the diameter of said upper disk.

6. A solenoid linear actuator according to claim [1] wherein the opening in said lower soft magnetic plate comprising a first sloping structure wherein the diameter of the opening in said lower soft magnetic plate gradually decreases downwardly.

7. A solenoid linear actuator according to claim [6] wherein said unibody soft magnetic core comprising a sloping structure with decreasing diameter transitioning from said central body to lower-end extrusion, corresponding to said first sloping structure in said lower soft magnetic plate.

8. A solenoid linear actuator according to claim [1] wherein the opening in said upper soft magnetic plate comprising a second sloping structure wherein the diameter of the opening in said upper soft magnetic plate gradually decreases downwardly.

9. A solenoid linear actuator according to claim [8] wherein said unibody soft magnetic core comprising a sloping structure with decreasing diameter transitioning from said upper disk to said central body, corresponding to said second sloping structure in said upper soft magnetic plate.

10. A solenoid linear actuator according to claim [1] further comprising a permanent magnet wherein said permanent magnet attracts and holds said soft magnetic core upward when said solenoid being de-energized; and repels said soft magnetic core downward when said solenoid being energized.

11. A solenoid linear actuator according to claim [10] wherein said permanent magnet has a ring shape with a central opening.

12. A solenoid linear actuator according to claim [11] wherein said soft magnetic core further comprising an upper extrusion with a diameter smaller than the diameter of the central opening of said permanent magnet, wherein said upper extrusion can go through said central opening of said permanent magnet without physically interfering with said permanent magnet.

13. A solenoid linear actuator in a coaxial radio frequency switch comprising:

a solenoid having multiple conducting wires wound around a bobbin;

a unibody soft magnetic core further comprising a central body and an upper disk and a lower end extrusion at its two ends;

an upper soft magnetic plate and a lower soft magnetic plate, wherein said upper and lower soft magnetic plates comprising openings which are primarily concentric to said soft magnetic core, and wherein the diameter of said opening in the upper soft magnetic plate is preferably larger than the diameter of said central body of soft magnetic core and smaller than the diameter of said upper disk, and the diameter of the opening in said lower soft magnetic plate is preferably larger than the diameter of said lower end extrusion;

a permanent magnet;

a pusher-conductor assembly supported by a restoring spring;

at least two conductor terminals;

wherein energizing said solenoid magnetizes said soft magnetic core and causes said soft magnetic core to be attracted to said upper and lower soft magnetic plates and repelled by said permanent magnet and pushes pusher-conductor assembly downward to connect said conductor terminals; and wherein de-energizing said solenoid causes said permanent magnet to attract and hold said soft magnetic core upward and causes said pusher-conductor assembly moving upward to disconnect said conductor terminals.

* * * * *